US006460925B1

(12) United States Patent
Kovacs

(10) Patent No.: US 6,460,925 B1
(45) Date of Patent: Oct. 8, 2002

(54) CHAIR-SUPPORTED BAG

(76) Inventor: Judith E. Kovacs, 371 Buffalo Ave., Calumet City, IL (US) 60409-2519

( * ) Notice: Subject to any disclaimer, the term of this patent is extended or adjusted under 35 U.S.C. 154(b) by 8 days.

(21) Appl. No.: 09/639,398

(22) Filed: Aug. 15, 2000

(51) Int. Cl.[7] ..... A47C 7/62

(52) U.S. Cl. ..... 297/188.04; 297/182; 297/188.2; 190/108; 190/102; 190/223; 190/228.1; 190/463.2

(58) Field of Search ..... 297/182, 188.01, 297/188.04, 188.06, 188.2, 223, 225, 228.1, 229, 463.2; 190/102, 108, 109, 111

(56) References Cited

U.S. PATENT DOCUMENTS 2,767,895 A * 10/1956 Smith
2,822,968 A * 2/1958 Jackson
2,979,098 A * 4/1961 Greaves
3,014,759 A * 12/1961 Bing
3,479,085 A * 11/1969 Weinstein
4,273,380 A * 6/1981 Silvestri ..... 297/191
4,650,103 A * 3/1987 Mitchell ..... 224/275
4,747,639 A * 5/1988 Pfau ..... 297/219
4,824,168 A * 4/1989 Makoski ..... 297/229
4,955,666 A * 9/1990 Baker ..... 297/182
5,050,713 A * 9/1991 Lee ..... 190/108
5,308,139 A * 5/1994 Rieger ..... 297/184.11
5,947,241 A * 9/1999 Rausch ..... 190/108

* cited by examiner

*Primary Examiner*—Yvonne M. Horton

(57) ABSTRACT

A chair-supported bag has a downwardly-opening first pocket adapting the bag to receive and be supported by the back of the chair. A second pocket is connected to and depends front the first pocket and opens upwardly for receiving and retrieval of articles such as pencils, erasers, crayons and the like

10 Claims, 1 Drawing Sheet

III
10
12
ABC
VI
VI
40
28
14
IX
IX
III
IV
IV
24
18b
30
18a
18
32
V
28
V
36
20
34
22
26

18
24
25
27
18
35
28
26
20
22

27
25
29
24

28'
18
31
32
33
20

24
18
19
18b
18a

17'
12A

17"
12B 23
21
20
22

CHAIR-SUPPORTED BAG

BACKGROUND OF THE INVENTION

1. Field of the Invention

The present invention relates to bags, and in particular to chair-supported bags for use in holding school, seminar and convention supplies.

2. Description of the Prior Art

Chair-supported bags, constructed in accordance with the present invention, are pertinent to, and find use, in situations in which a plurality of people are gathered in a room for a specific purpose, and objects pertinent to the gathering are to be stored and made readily accessible to each respective person.

There are many situations in which supplies are required for a plurality of persons. Typical of these are preschool and kindergarten classes in which the children so not sit at desks, but at tables and do not have a place to keep pencils, erasers, crayons, scissors, glue and the like. These must be stored in containers, such as cigar boxes and what are known as pencil boxes. These containers get in the way and sometimes get knocked onto the floor spilling, and sometimes breaking. the contents. The supplies could be stored out of the way, but readily accessible with a bag constructed in accordance with the present invention.

Another situation is seminars wherein seminar materials, pencils, pens and the like, are handed out to each participant, generally in a folder. These materials could be packaged for the participants in advance and mounted on each chair of a seminar setup by using a bag constructed in accordance with the present invention.

Also, it is common practice in conventions for interested parties, or sponsors, to give out samples of their products by placing the samples on chair seats, or on a table top in front of the chairs. These objects could easily become scrambled on table tops and knocked off of the table tops and chair seats. By using a bag constructed in accordance with the present invention, the sample gifts could be placed in a bag which is supported by a respective chair for each conventioneer.

There are bags as options, for toilet articles, such bags having sections with transparent front panels and a hook or loop at the top for hanging from a coat hook or over a bathroom door.

Accordingly, it is an object of the invention to provide a chair-supported bag for use in school, seminar and convention situations in which a plurality of people are required to store and have access to objects such as pencils, crayons, erasers, papers, and/or gift items.

Another object of the invention is to provide a bag portion for such a chairsupported bag that is at least partially transparent for visual identification of objects therein.

Inasmuch as sponsors and seminar operators have an interest in their businesses, another object of the invention is to provide a surface area on the bag for advertising, such as logos, names and the like.

These and other objects are achieved, according to the invention, by providing a chair-supported bag which has an upper envelope pocket for receiving the back of a chair and a lower envelope pocket, preferably transparent, for receiving and holding objects which may be easily retrieved therefrom.

BRIEF DESCRIPTION OF THE DRAWINGS

Other objects, features and advantages of the invention will be best understood from the following description taken in conjunction with the accompanying drawing, on which.

DESCRIPTION OF THE PRESENTLY PREFERRED EMBODIMENTS

Figures 1, 2, 3, 4, 5, 6, 7, 8, 9:
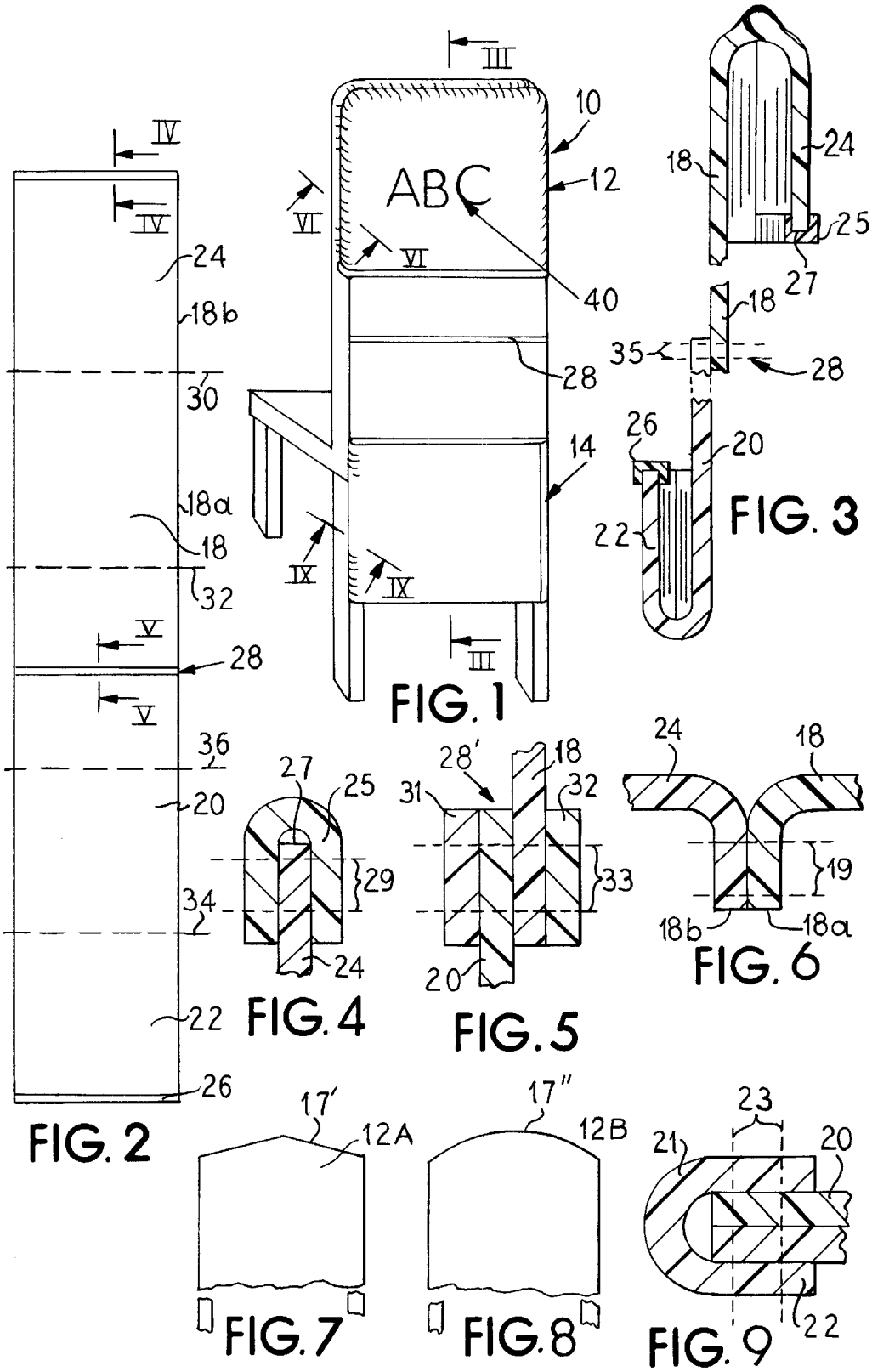
FIG. 1 is a perspective view of a chair-supported bag, constructed in accordance with the invention mounted for use on, and supported by, the back of a chair.
FIG. 2 is a plan view of the material for constructing the bag of FIG.1 showing fold lines and the like for reference.
FIG. 3 is a sectional view taken along the parting line III—III of FIG. 1.
FIG. 4 is a sectional view of bound edges relating to the pocket openings and taken along the parting line IV—IV of FIG. 1.
FIG. 5 is a sectional view taken along the parting line V—V of FIG. 2 showing the taping and sewing for joining two sections of the bag together.
FIG. 6 is a sectional view taken along the parting line VI—VI of FIG. 1. showing the joining of lateral edges of the lower envelope pocket of the bag of the invention.
FIG. 7 is a partial rear view of the top of a chair back showing the shape of the bag for a triangular-shaped chair back top.
FIG. 8 is a partial rear view of the top of a chair back showing the shape of the bag for an arcuate-shaped chair back top.
FIG. 9 is a sectional view taken generally along the parting line IX—IX of FIG. 1.

Referring to FIG. 1, a chair supported bag, constructed in accordance with the invention, is illustrated mounted on a chair generally at 10. The bag is seen to comprise an upper section 12 and a lower section 14. As will be evident, the upper section 12 includes an envelope pocket which opens downwardly for receiving the chair back therein and the lower section 14 which includes an envelope pocket which opens upwardly for receiving and storing objects therein. This latter envelope pocket is, preferably, transparent for visual identification of objects therein.

Referring to FIG. 2, the bag is constructed from a pair of subpanels 18 and 20 which are delineated at the element 28. The subpanel 18 is connected to the subpanel 20, as shown at 28 by the structure illustrated in FIG. 5. This is because the preferred embodiment for children's use incorporates a clear, transparent material, such as a clear plastic material, for the subpanel 20, whereas the material of the upper subpanel 18 may be an opaque material, preferably a stretchable vinyl material. Stretchable material is preferred in that even standard chair models differ slightly in width.

During fabrication, and referring to FIG. 2, the top of the subpanel 18 is bound as shown in FIG. 4 by applying a strip of material 25 which is folded over the edge 27 and then double stitched thereto as indicated at 29, then the section 24 is folded over the section 18 so that the element 28 is located at a location designated by the line 30, its lateral edges registered and joined together as shown in FIG. 6 wherein the edges 18*a* and 18*b* are double stitched thereto as indicated at 19 in FIG. 6. The strip 25, as well as the other strips mentioned hereinbelow, may advantageously be of the same material as that of the sections 18 and 24.

Inasmuch as vinyl fabric usually is manufactured to have a finished side and an unfinished side, the subpanel 18 and the section 24 are folded, inside the resulting envelope pocket. Then the envelope pocket is turned inside out before the subpanel 18 is attached to the subpanel 20. This provides the seams on the inside, as shown in FIG. 6, and a smooth outside for the upper envelope pocket.

Before attachment to the upper subpanel 18, the lower subpanel 20 is fabricated to form the lower envelope pocket by first binding the edge as indicated at 26 and as also shown in FIG. 4 for an edge binding and being the same as for the edge 27. The section 22 is then folded over the subpanel 20 in the same manner as discussed above for the section 24 so that the binding 26 is located generally at the line 34 with the lateral edges registered. FIG. 9 shows the cross-sectional structure of these connections in which a strip of material 21 is folded over and covers the edges of the seam and is stitched to the sections 20 and 22 as a double stitching 23.

The basic construction is illustrated in FIG. 3 which shows the upper and lower envelope pockets connected by what can be termed a center panel which is made up of the two subpanels 18 and 20. As can be easily seen, the folds for the pockets are opposite to one another so that the upper pocket opens downwardly on one side of the center panel and the lower pocket opens upwardly on the opposite side of the center panel. The two subpanels 18, 20 may joined together by simple double stitching (28, 35, FIG. 3) or the application of strips of material 31,32 on opposite sides and double stitching as indicated at 28', 33 in FIG. 5.

It should be noted that the positions of the lines 30, 32, 34 and 36 in FIG. 3 are arbitrary according to the bag being fabricated.

A chair-supported bag, according to the present invention may take several embodiments, all of which are basically the same. Each embodiment has an upper envelope pocket for receiving the back of a chair. A bag portion is suspended from and depends from the upper portion and comprises an envelope pocket which opens upwardly for receipt of objects to be stored therein and easy removal of those objects.

Referring to FIGS. 7 and 8, chair backs of different configurations can be accommodated in the fabrication of the upper envelope for receiving a chair back. In FIG. 7, a pointed top is shownat 17' for accommodating a similarly-shaped chair back. In FIG. 8, an upper envelope shape is shown at 17" for accommodating an arcuate-shaped chair back. In cases such as these, the section 24 is folded over the subpanel 18 and then double stitching is done along predetermined lines 17", 17'" to form the pointed or arcuate shape, respectively, before the pocket is turned inside out. Excess material outside of the sewing may then be cut off before turning the pocket inside out.

In a preferred method of fabrication, the bottom pocket is made first and the the bottom pocket is conneced to the fabric for the upper pocket, as generally shown in FIG. 2 at 28, and then the upper pocket is formed.

It is also evident that the bag can be made of a single piece of fabric simply by folding and stitching.

The bag may also be fabricated by using three pieces of material, one for the center panel, one outer piece for the upper pocket and oneouter piece for the lower pocket. All pieces could then be joined by seams, as shown in FIG.9 This method of fabrication is, however, more labor intensive.

As used herein, the terms "object" and "object" are to include all types of supplies that would be use in a preschool or kindergarten, seminar, convention (gifts) and the like. The term "chair" is to include any type of chair, such as a wheel chair or baby stroller wheere the bag is hung from the back rest or the handle, respectively.

In libraries, the chair-supported bag of the present invention will be particularly useful in the children's and reference sections. Call slips, pencils and the like may be stored therein.

For children, it is important to provide for visual identification through the use of clear material for the bottom envelope pocket. However, for seminar participants and conventioneers it is not so important, and opaque materials should suffice.

As mentioned above, it may be advantageous for seminar operators and sponsors at conventions to have advertising on the bags. This can be provided as at 40 in FIG. 1 by the application of logos, and/or alphanumeric characters printed on the opaque material, either on the front or on the back.

If heat or chemically-fusable material if used, it is possible to make the seams by heat bonding, such as by using RF techniques, by adhesion or chemical bonding and the like.

Although I have described my invention with respect to certain illustrative embodiments thereof, many changes and modifications can be made by one skilled in the art and it is intended that all such changes and modifications be included within the scope of my contribution to the art.

I claim:

1. A bag adapted to be supported by a back of a chair, said bag comprising:

first and second elongate sections each including first and second ends, said first ends overlapped and connected together to form an elongate center panel, at least one strip of reinforcing material covering and attached to said overlapped ends, each of said sections including the same predetermined lateral width limited by opposite lateral edges;

a first lateral fold across said first section, and a first portion extending between said first lateral fold and the respective second end and overlying a like first portion of said center panel, respective lateral edges of said first portion and said center panel in registry and connected together to form a first pocket that opens downwardly for receiving and adapting said bag to be hung from the back of chair;

a second lateral fold across said second section, and a transparent second portion extending between said first lateral fold and the respective second end and overlying a like second portion of said center panel, respective lateral edges of said second transparent portion and said center panel in registry and connected together to from a second pocket that opens upwardly for receiving an retrieval of articles wherein the second pocket is disposed on a side of the center panel opposite the first pocket.

2. The bag of claim 1, and further defined wherein:

said first elongate section and said first section each comprise stretchable material.

3. The bag of claim 1, and further defined wherein:

said first elongate section and said first section each comprise stretchable vinyl material.

4. The bag of claim 1, and further defined as comprising:

stitching extends through said at least one strip of material and said overlapped ends.

5. The bag of claim 4, and further defined wherein:

said stitching comprises double stitching of said strip of reinforcing material and said overlapped first ends.

6. The bag of claim 1, and further defined as comprising:

a first strip of material embracing said registered first lateral edges;

a second strip of material embracing said registered second lateral edges; and double stitching connecting said first and second strips of material to the respective registered lateral edges.

7. The bag of claim 1, and further defined as comprising: at least one surface area on said bag carrying indicia.

8. A method of making a bag adapted to be supported by a back of a chair, the method comprising the steps of:

A. forming a first envelope pocket at a first end and on a first side of an elongate rectangular piece of stretchable material to open in a first direction toward a second end of the piece of material for receiving and adapting the bag to be hung from the back of the chair by (A1) folding the first end of the first rectangular material over the material on the first side, (A2) registering respective lateral edges upon folding, (A3) binding the respective registered lateral edges to form the first pocket therebetween, and (A4) turning the first pocket inside out to reform the first pocket and locate the bindings therein;

B. forming a second envelope pocket of a first end and on a first side of an elongate rectangular piece of transparent material to open towards a second end of the piece of transparent material for receiving objects therein;

C. turning at least one of the first and second pieces of material with respect to the other such that the first sides face in opposite directions; and D. overlapping and connecting the second ends of the first and second pieces of material together to form a unitary structure.

9. The method of claim 8, wherein the step (A3) further comprises the step of:

(A3a) stitching the registered lateral edges, and (A3b) stitching along a predetermined line across the first pocket to define a predetermined outline of a chair bag.

10. The method of claim 8, wherein the step (B) of forming a second envelope pocket is further defined as comprising the steps of:

(B1) covering and binding a transverse edge of the first end of the piece of transparent material;

(B2) folding the bound edge over the transparent material on the first side of the transparent material;

(B3) registering respective lateral edges of the folded portion with corresponding lateral edges of a like portion of the transparent material; and (B4) binding the respective registered lateral edges to form the second envelope pocket.

* * * * *